US006348757B1

(12) United States Patent
Marini

(10) Patent No.: US 6,348,757 B1
(45) Date of Patent: Feb. 19, 2002

(54) REINFORCED SUPRACONDUCTIVE MATERIAL, SUPRACONDUCTIVE CAVITY, AND METHODS FOR MAKING SAME

(75) Inventor: Jean Marini, Marly le Roi (FR)

(73) Assignee: Centre National de la Recherche Scientifique, Paris (FR)

( * ) Notice: Subject to any disclaimer, the term of this patent is extended or adjusted under 35 U.S.C. 154(b) by 0 days.

(21) Appl. No.: 09/508,693

(22) PCT Filed: Nov. 29, 1998

(86) PCT No.: PCT/FR98/02068

§ 371 Date: Jun. 23, 2000

§ 102(e) Date: Jun. 23, 2000

(87) PCT Pub. No.: WO99/17592

PCT Pub. Date: Apr. 8, 1999

(30) Foreign Application Priority Data

Sep. 29, 1997 (FR) ..... 97 12079

(51) Int. Cl.[7] ..... H05H 7/18

(52) U.S. Cl. ..... 313/359.1; 315/502; 315/505

(58) Field of Search ..... 315/500, 501, 315/502, 503, 504, 505, 111.61, 111.41; 313/359.1, 360.1, 62; 332/133; 505/150; 427/62

(56) References Cited

PUBLICATIONS

Alain Proner, Societé Arega, pp. 1 to 20, "Revètements Par Projection Thermique".

W. Weingarten, Cern—European Laboratory for Particle Physics, pp. 129 to 142, "Progress in Thin Film Techniques", Oct. 1995.

F. Rosario, et al., Institute for Advance Materials, pp. 199 to 234, "Plasma Spraying—A Versatile Coating Technique", 1992.

*Primary Examiner*—Nimeshkumar D. Patel
*Assistant Examiner*—Thelma Sheree Clove
(74) *Attorney, Agent, or Firm*—Oblon, Spivak, McClelland, Maier & Neustadt, P.C.

(57) ABSTRACT

The objective of the invention is a process for producing a rigidified structure, comprising at least one element with superconducting properties, and the means for rigidifying, this process comprising a stage of deposit by plasma spraying of a layer of material on a surface of said element.

10 Claims, 3 Drawing Sheets

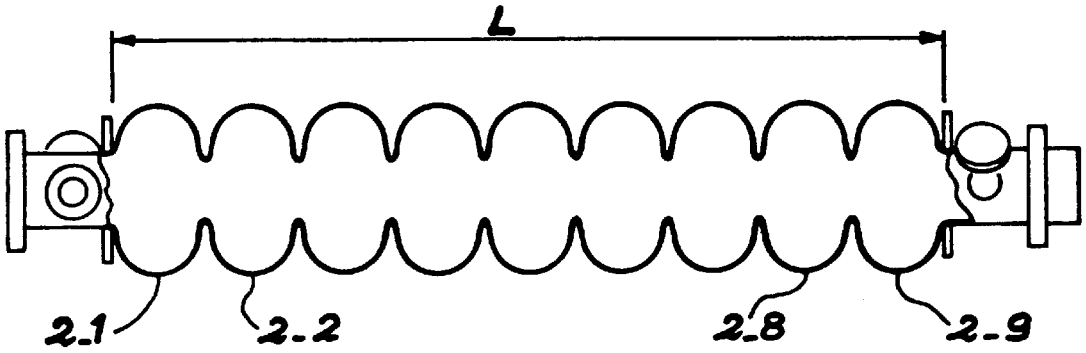
PRIOR ART FIG. 1A
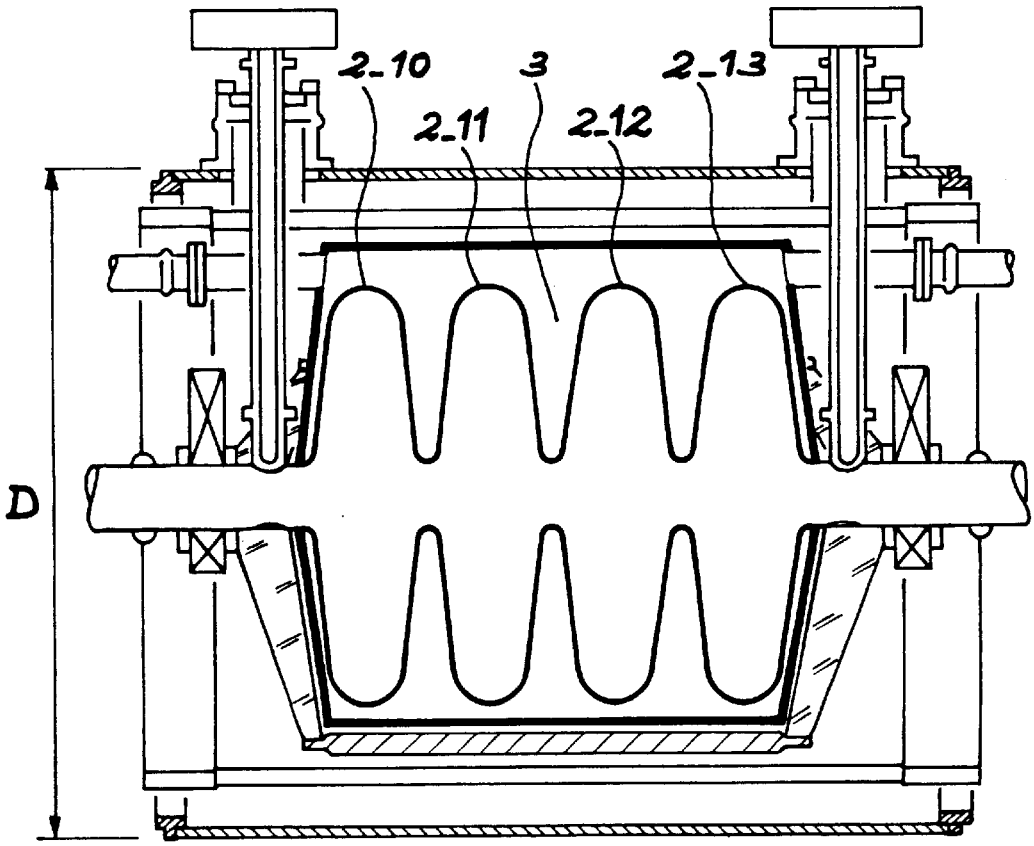
PRIOR ART FIG. 1B

REINFORCED SUPRACONDUCTIVE MATERIAL, SUPRACONDUCTIVE CAVITY, AND METHODS FOR MAKING SAME

TECHNICAL FIELD

The present invention relates to the production of structures associating a superconducting material with a mechanical reinforcement material, possessing good thermal characteristics. An example of such a structure is that of sheets, or narrow tubes, of niobium associated with a rigidification layer, for example in copper or in tungsten.

Such structures offer applications in the field of particle accelerators.

PRIOR ART

FIG. 1A represents an accelerating structure of an electron accelerator. Such a structure takes the form of successive cavity cells 2-1, . . . , 2-9. The particles are accelerated here by a radio-frequency wave generated by a klystron. Length L is 1039 mm for a frequency of 1.3 GHz.

FIG. 1B represents a structure for accelerating protons. Cells 2-10, . . . , 2-13 in niobium are immersed in a bath 3 of liquid helium. Such a structure has a diameter D of 1.1 m for a frequency of 700 MHz.

The shape and the dimensions of these cavities are optimised according to a large number of parameters linked to the RF performance, dark currents, turbulence field etc. Resolution of the Maxwell equations associated with the conditions at the limits on the walls makes it possible to define space and time values for the electric and magnetic fields in such a structure.

These electric and magnetic fields contribute to the accelerating effects on the particles of the beam, but also to secondary effects, in particular the heating of materials and structures, dark currents etc.

In particular, a current j induced in the cavity walls leads to a loss of high frequency power.

At present, there is a distinction between two types of accelerators: the so-called "hot" accelerators made with copper cavities, and the "superconductor" accelerators using cavities of a superconducting material such as niobium, which is cooled below its critical temperature $T_C$ to make it superconducting. The critical temperature $T_C$ for niobium is 9.3 K, which implies cooling the structure in a bath of liquid helium (at atmospheric pressure helium is liquid at 4 K).

In the first case, for hot accelerators, a large part of the electrical power provided by the network serves to heat the cooling water in the copper structures. In the case of a superconductor accelerator, the greater part of the electrical power serves to accelerate the particle beam, which helps explain all the interest of superconductivity in terms of electrical consumption. However, a small part (but not zero) of the HF energy is dissipated in a fine layer of superconducting material called the LONDON layer. The typical thickness of the LONDON layer is about 100 nm and does not depend on the frequency, as is the case for currents induced in a normal conductor. This dissipated energy makes it possible to explain the variations in the characteristic curve of a superconductor cavity $Q(E_{acc})$, or quality factor, depending on the accelerating field. Since the dissipated energy rises with the accelerating field, the characteristic curve follows a descending slope depending on the field.

The BCS theory on superconductivity worked out by Bardeen, Cooper and Schrieffer in 1957 makes it possible to predict the corresponding resistance, (the so-called BCS resistance) and the losses from the Joule effect, which depend on the frequency and temperature.

To this resistance $R_{SCS,}$ one should add a residual resistance linked to the defects of structures, interstitial atom impurities, included gases etc.

Thus, in a structure of superconducting cavities, one can consider that the thickness of the superconducting material (niobium, for example), constituting the superconducting cavity, plays several roles:

1—The role of superconducting layer as an internal skin, on the vacuum side of the cavity.

2—The role of heat sink for the rest of the thickness, allowing the calories generated by the BCS and residual resistances in the LONDON layer to flow towards the helium bath.

3—The role of mechanical structure making it possible to conserve the internal shape fixing the conditions at the limits to the electromagnetic field which is created in the structure of the tube and in the accelerating cavities.

The optimisation mentioned above makes it possible to reach compromises allowing in general the optimisation of the RF (or HF) shapes and specifications but leaves open the questions of mechanical stability and the thermal properties of such structures.

When an accelerating machine is used, the mechanical and geometric conditions must remain stable in order to maintain the structure of the cavities tuned to the klystron frequency. Various causes may disturb this operating stability: Lorentz forces creating pressure in the cells and tending to deform them, mechanical vibrations induced from outside, and in particular induced by variations in the pressure of the liquid helium bath etc.

In transient states, when the HF wave is introduced into the cavities, the structure is submitted to Lorentz forces which tend to deform and detune it. To avoid this, rigid structures need to be produced.

An example of such a rigidified structure is illustrated in FIG. 2A. A corrugated tube 4 is produced with a high thickness of superconducting material, generally niobium, which is expensive. In fact, the tube is an assembly of elementary parts 5, 7, 9, 11 assembled by welds 6, 8, 10.

The utilisation of thick niobium means using a large quantity of very expensive material (between 1,500 FF and 5,000 FF per kilo), a procedure which can scarcely be envisaged for machines operating with a high number of cavities.

Another known structure, represented schematically in FIG. 2B, consists of making cavity parts in material 12 of average thickness, of welding them together with welding seams 16 and strengthening them with a ring 14 at the level of the iris (regions or zones of lower diameter). Consequently, in order to overcome the effect of the Lorentz forces, the utilisation of niobium of lower thickness necessitates welding stiffeners 14, complicating the production process and making it difficult to control the dimensions because of shrinking after welding. In addition, such a technique makes it difficult to obtain reproducible dimensions.

Another technique (FIG. 2C) consists of depositing a thin layer 22 of niobium on a substrate 20 in thick copper. This process makes it possible to solve the problem of rigidifying the structure. However, the structure obtained has limits in terms of the accelerator field which can be reached. In fact, for reasons linked to the structure of the superconducting layer of niobium deposited by "sputtering" on the copper substrate, the maximum electric fields likely to be reached remain of the order of 10 MV/m. For other machines, and in particular colliders $e^+$-$e^-$, this field is clearly insufficient.

Apart from the mechanical problems, there are also thermal problems. Thermal conditions must be maintained so that the internal skin of the niobium remains below the critical temperature $T_C$ and below the critical field $H_C$. In order that the thermal conditions are maintained and the niobium remains superconducting in the LONDON thickness, it is necessary that if there is a hot spot on the internal surface, on the vacuum side of the accelerator, the calories can be evacuated rapidly towards the helium bath.

There are several reasons which can lead to the creation of a hot spot:

1)—HF losses through the Joule effect, due to the uniformly distributed global and homogeneous surface resistance described by the BCS theory and by the residual resistance. A more complete theory introducing non-quadratic losses, presented by W. Weingarten ("Progress in thin film techniques", CERN-European Laboratory for Particle Physics, Geneva, Switzerland, 7th Workshop on RF Superconductivity, Paris, 1995), shows that it is possible to express super-losses by the following formula, giving the superconducting resistance (measured in nΩ/mT):

$$R_s(B_p, \omega, T, B_{ext}) = \frac{R_0(\omega)}{T}\exp\left[\frac{\Delta}{KT_c}\right] + R_{res}(\omega, B_{ext}) + R_s(\omega, T, B_{ext})\cdot B_p + \cdots \quad (1)$$

The first term gives the BCS losses, the second the losses due to residual resistance and the third the non-quadratic losses.

The losses corresponding to the second and third terms are explained by non-superconducting metallic inclusions such as tantalum which, after the metallurgical processes for working niobium, are still present in the niobium matrix, and also by dissolved impurities (oxygen, carbon etc.)

2)—The HF losses due to the field emission and, possibly, also due to electron emissions through the thermoionic effect. According to the Fowler-Nordheim theory, above a certain surface field, electrons are extracted from the surface. They can then be accelerated by the electromagnetic fields present in the structure.

These electrons, emitted by the field effect and accelerated by the electromagnetic wave, can then collide with the structure of the cavities, in another place, and dissipate their kinetic energy in the form of heat.

3)—Dielectric HF losses, from dust and contaminants of a dielectric nature which may have been left inside the cavities during the manufacturing process.

To minimise these "hot spot" sources, extremely pure niobium must thus be used, work must be carried out at low temperatures, smooth surface conditions must be obtained, and all dust deposits on the HF side must be avoided.

In addition, if one wishes to work with a high accelerating field, and thus as a consequence with a high magnetic field as well in the region of the equator, it is not possible to avoid creating heat. As Padamsee showed in "calculations for breakdown induced by large defects in supraconductive niobium activities", published in IEEE Translations on Magnetics, vol. 19, 1983, even in the absence of defects, if one reaches the critical field $H_C$ locally, the material passes from the superconducting state to the normal state.

Below this limit, the heat thus produced at the internal wall of the cavity must be evacuated, as efficiently as possible, towards the helium bath, in such a way as to limit the rise in temperature of the internal wall of the cavity.

If the speed of access to the cold source is insufficient, a localised thermal perturbation may spread and lead eventually to a breakdown of the cavity, called "quench" in anglo-saxon jargon (transition of the HF wall from the superconducting state to the normal resistive state).

Thus a "quench" or "thermal breakdown" generally originates in a region where a higher resistance exists, or in a "non conduction" zone, or a defect or a foreign particle on the surface of the superconducting material.

If, locally, at a defect, more heat is produced than can flow in the direction of the helium bath, the temperature of the zone rises and tends to become a zone of "non-super" conductivity, which then extends until the whole of the energy stored in the cavity is dissipated in the hot region.

Thus one understands that one tries to obtain high thermal conductivity of the cavity wall to avoid this problem of "thermal breakdown", and also low values of accelerating fields.

Moreover, the power density generated by the currents in the LONDON layer is proportional to the square of the local magnetic field $B_S$. Yet, the value of the local magnetic field B(s), along the meridian, has a maximum value obtained at the equator (the zone with the biggest diameter).

From the equator, and in the direction of the iris, $B_S$ reduces slowly, then more rapidly when one passes from the equator to the iris.

A defect will therefore not be as harmful situated at the equator as it will be situated very far from the equator, towards the iris. In addition, the equator zone is especially sensitive from the point of view of superconductivity defects since the Foucault currents induced at the level of normal electrons, in the inside skin, will be greater in this zone because of the high value of the magnetic field.

Consequently, the "harmfulness" of a defect is not identical, depending on its geographic location in the cavity. Moreover, all things being equal, situated near the equator, in a zone where the magnetic field is at a maximum, it will have a tendency to show more harmfulness vis-à-vis the "quench" than if it is situated in the neighbourhood of the iris.

On the other hand, a defect on the surface or very close to the surface, in the neighbourhood of the iris, will be more sensitive to the electric field and will be likely to emit electrons according to the Fowler-Nordheim law, or possibly even (according to the Richardson law), simply by thermoionic effect.

When one produces superconducting cavities following the present process, using niobium sheets which are pressed and welded from the outside by electron beam, defects are introduced. Impurities are localised at the fusion bath and therefore, for the process used at present, at the lower end of the weld seam, on the vacuum side of the structure.

Since, in addition, the present process consists of making a weld at the equator and that one has seen above that this is the zone with the highest magnetic field, this process is very likely to create a hot spot in this region.

Moreover, since niobium has an affinity for oxygen, there needs to be a very good vacuum in the vessel when the welds are carried out by electron beam. Studies have shown that, during the welding process, the bath of metal in fusion absorbed oxygen from the vessel and thus created locally a zone where the purity of the niobium was debased.

All these considerations demonstrate the difficulties which have to be overcome at the industrial level to produce, in a reliable manner and with reproducible results, an object which has as many "badly placed" welds (from the point of view of "super" defects) as those shown in FIGS. 2A or 2B. Moreover, it is difficult to obtain reproducible vacuum conditions at levels as low as $10^{-9}$ torr when welding by electron beam.

The present structures, of the type shown in FIGS. 2A and 2B, use a large number of welds and these zones are especially critical, above all those located at the equators.

In addition, the welding techniques practised have a tendency to concentrate the impurities towards the inside (where the LONDON layer is located) and this, among other things, raises the residual resistance.

In order to combat the "quench" phenomenon, or the thermal runaway of the cavity, following the appearance of a hot spot, known structures need to use materials of great purity with a high thermal conductivity (corresponding to an RRR at least higher than 200), that is to say materials whose purification costs come on top of the usual costs of standard industrial materials. (The RRR, the "Residual Resistance Ratio", is a measure of the purity of the material, involving defects in structure and microscopic or macroscopic defects. It is also defined by the relationship between the cold electrical resistivity and the resistivity at ambient temperature).

But, in the case of niobium, even of one uses very pure niobium, one should note that the thermal conductivity of this material is not very good compared, for example, with that of copper or aluminium. In addition, in the case where the heat flux created by a hot spot cannot be absorbed by the thickness of niobium, one should note that the niobium/liquid helium interface resistance is not negligible.

Thus, the structures and processes described above do not make it possible to obtain both the mechanical stability and the thermal conditions required, in particular for high accelerating fields.

Documents JP-0 2220399 and JP-0 2220400 (Patent Abstracts of Japan, OEB) suggest a special production technique for superconducting niobium cavities whose walls are covered with a metal which is a good thermal conductor using a process of application by plasma spraying.

Thanks to this technique one can produce a superconducting cavity, comprising a sheet or tube in superconducting material, with the appropriate shape and with improved thermal properties.

However there remains the problem of rigidity of the cells and the cavity.

As mentioned above, the rigidity of a cavity with a multiple cell structure can be raised by welding stiffeners in the shape of rings (FIG. 2B).

Apart from the above-mentioned problems of mechanical restrictions due to shrinkage of the welds, it seems that the presence of rings is scarcely compatible with the technique of plasma spraying.

DESCRIPTION OF THE INVENTION

An aim of the present invention is to propose an accelerator cavity and a manufacturing process for such a cavity making it possible to solve the problems laid out above.

A particular aim is to propose such an accelerator cavity offering excellent thermal properties and mechanical rigidity at an especially low cost.

The rigidity of the cavity can certainly be increased by applying a thicker plasma-projected layer of metal. However, the production of a thick layer of metal, apart from the cost it represents, becomes long and complex, taking into account the conditions for plasma spraying.

Thus, in order to achieve the above aims, the invention has more precisely the objective of a particle accelerator cavity with a string of multiple cells, the cells presenting a region with a higher diameter, called the equator region, and end regions of lower diameter called iris which link the cells between them, the cells being delimited by a wall in a material with superconducting properties, which is covered by at least one layer of thermal conducting material, characterised in that the layer of thermal conducting material has a thickness which is greater in the iris regions than in the equator region of the cells.

It is to be noted that by simply increasing the thickness of the thermal conducting material in the iris regions of the cells, it is possible to raise significantly the mechanical rigidity of the cavity. The non-uniform character of the thickness in fact makes it possible to combat efficiently the Lorentz forces acting on the wall. Thus, the setting of rings or other rigidity reinforcements becomes superfluous.

The lower thickness of the thermal conducting material in the equator regions does not prejudice the rigidity.

A smaller quantity of thermal conducting material can be used and the application time for this material can be reduced. The manufacturing costs of the cavity are thus lowered.

In addition, when higher rigidity of the cavity is obtained, the thickness of the superconducting material can be reduced as well. This also contributes to lowering the costs.

A cavity conforming to the invention can be used particularly for electron or proton accelerators.

As mentioned above, the thermal conducting material can be applied by plasma spraying.

Plasma spraying makes it possible to obtain a porous structure producing an interface whose total developed surface can be greater than that obtained by prior art. This increase in the exchange surface makes it possible to improve the thermal exchanges between the liquid helium and the possible heat source which could develop locally.

The increase in the exchange surface between materials makes it possible to reduce the Kapitza resistance, or interface thermal resistance, which is one of the physical properties determining the thermal performance of the superconducting structure.

The coating process by plasma spraying, depending on the size of the constitutive particles of the powders, and according to the settings of the plasma torch, makes it possible to obtain porous layers whose porosity can be adjusted.

Besides the thermal advantage explained already, such a layer, while rigidifying the structure, also makes it possible to absorb efficiently the vibrations of the corrugated skin of the superconducting material.

In the case where the superconducting material is niobium, one can increase the exchange surface further by advantageously spraying a thin layer of niobium on the external face of the structure, before spraying the copper or the second material to rigidify the structure. In addition, in order to facilitate thermal exchanges, the layer of thermal conducting material can be coated with a layer of a material with acoustic impedance lower than that of the thermal conducting material.

In fact, one can improve the Kapitza resistance between the copper (or the plasma deposited material) and the liquid helium by spraying, for example, a layer of aluminium making the acoustic adaptation between two elements, one solid and with a high acoustic impedance and the other liquid with low acoustic impedance.

In the case where the shape of the cells allows it (that is, in the case where the relationship between the diameter at the equator and the diameter of the iris is not too high), one can shape the cavity from a tube without welding, deformed by a known procedure such as hydroforming, tube expanding, hot working, hydrosparking, magnetic forming etc. Once the tube has been obtained with its corrugations, instead of welding an external ring, as in prior art (FIG. 2B), the structure is rigidified by spraying powder externally, for example copper, on the outside surface. One can also use tungsten or any other material possessing good thermal properties.

In the case where the dimensions of the cavities are such that one cannot use a process of tube shaping without welding, without tearing the metal, one can start from thin pressed sheet elements joined by welds carried out by laser beam or electron beam according to known techniques. Since a weld at the equator presents a significant risk, one can advantageously offset it to another location.

Once the structure with its corrugations has been obtained, comprising successive cells, the ensemble is rigidified externally by plasma spraying of the thermal conducting material as described above.

By thermal conducting material one means a material possessing good thermal properties enabling the "quench" to be evacuated. For example, copper and tungsten are good candidates.

A further aim of the invention is a process for making an accelerator cavity comprising a plurality of cells with equator regions of higher diameter and iris regions of lower diameter, and delimited by a wall of a material with superconducting properties, in which a layer of thermal conducting material is formed on the surface of the said wall by plasma spraying. According to the invention, the thermal conducting material is sprayed in such a way that it forms a thicker layer in the iris regions than in the equator regions.

BRIEF DESCRIPTION OF THE FIGURES

Other characteristics and advantages of the invention will be better appreciated in light of the following description. This description concerns production examples, given as an explanation but not limited to, referring to the drawings in the appendix in which:

FIGS. 1A and 1B, already described, represent known superconducting cavities, for an electron or proton accelerator.

DETAILED PRESENTATION OF THE EMBODIMENTS OF THE INVENTION

A process for producing a cavity, according to the invention, uses an element, for example a sheet or fine tube of superconducting material, for example niobium, of thickness lower than or equal to 1 mm (for example 0.5 mm or several tenths of a mm) which needs to be rigidified by an external coating. In fact, one carries out plasma spraying on the external surface of the element in superconducting material. The procedures for powder spraying by plasma technique are, for example, described in the article by M. DUCOS entitled "Revêtement par projection thermique" which was published in Technique de l'Ingénieur, volume M5, 1645, pages 1–23. The article by F. Brossa et al. entitled "Plasma Spraying, A Versatile Coating Technique" published in Advanced Techniques for Surface Engineering, W. Gisoler and H. A. Jehn, Editors, 1992, also describes this technique.

The structure obtained thus comprises the element chosen, for example a sheet or a tube, coated with a material sprayed by plasma and which has the characteristics described in the article of M. DUCOS mentioned above (see in particular §2.2 of this document). In particular, the coating has a certain porosity. This is the case especially for a coating of copper or tungsten deposited on a sheet or thin tube of niobium. In the case of application to a superconducting cavity, this porosity makes more efficient cooling possible. In fact, the cavity is immersed in a bath of liquid helium and the latter, because of its properties, can easily enter the porosities of the coating material. The result is more efficient cooling of the structure.

In the case where the shape of the cavity allows it, one can produce it from a tube without welding, which is deformed by a known procedure such as hydroforming or hydroforming with buckling. One can also use hot working or hydrosparking.

Figure 2A:
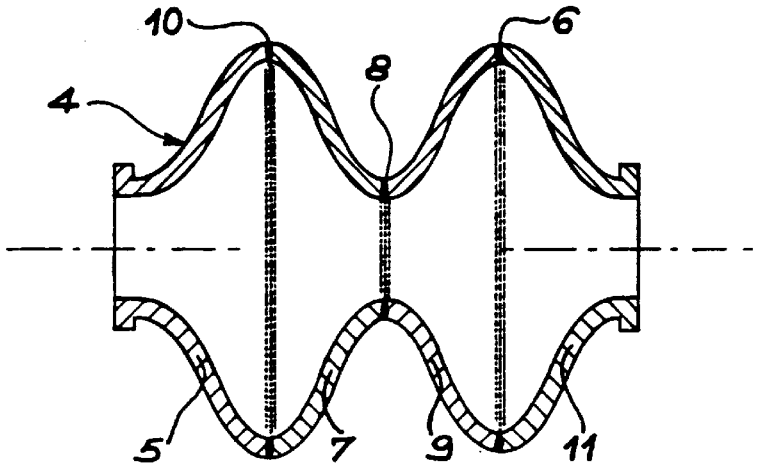
FIG. 2A PRIOR ART
FIGS. 2A, 2B and 2C, already described, represent known superconducting cavities, rigidified.
Figure 2B:
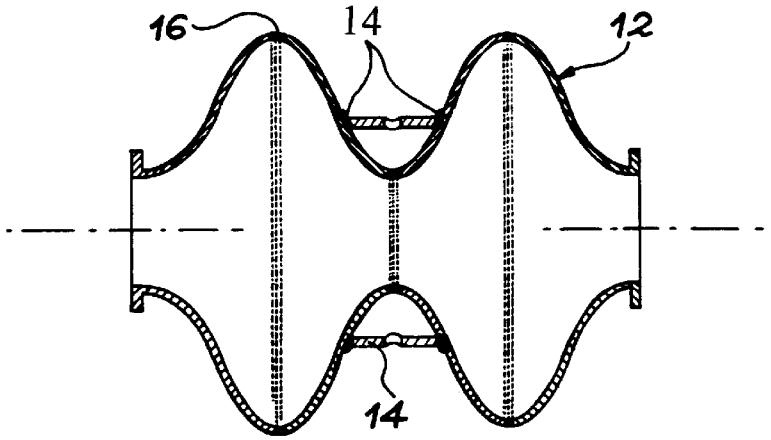
FIG. 2B PRIOR ART
Figure 2C:
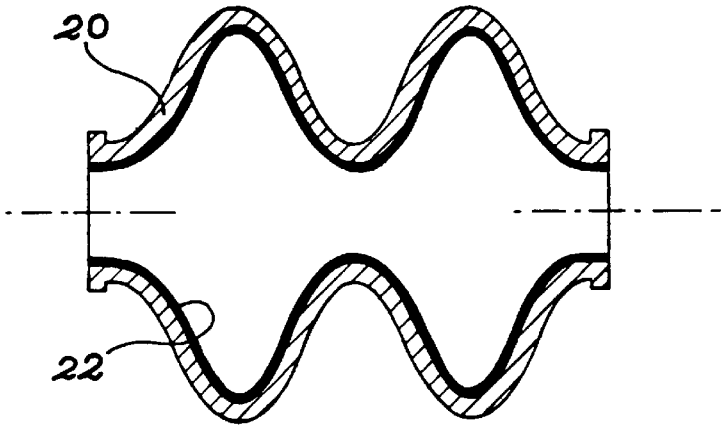
FIG. 2C PRIOR ART
Figure 3:
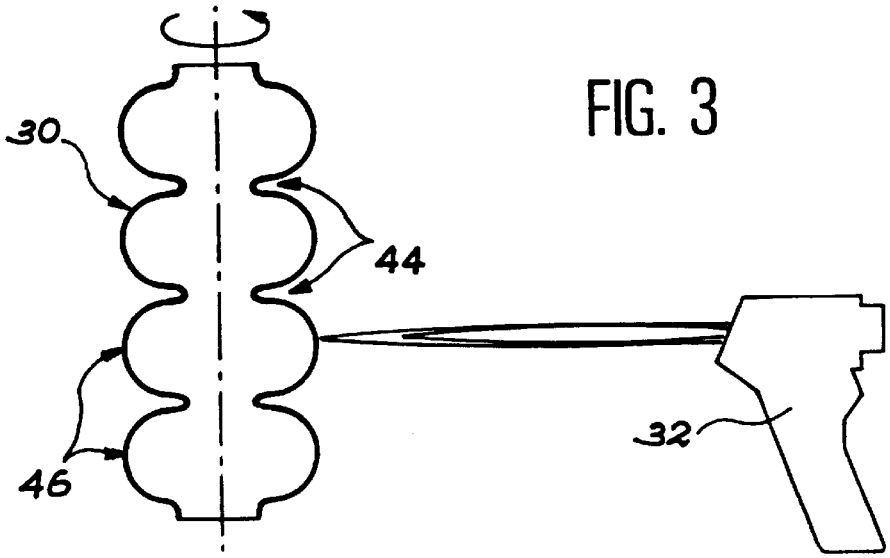
FIG. 3 represents a plasma spraying process of a material for producing a cavity according to the invention.

FIG. 3 represents a fine corrugated structure in niobium 30, which is coated by plasma spraying with the aid of a torch or a spray gun, 32. A plasma torch, or plasma spray gun, is described in the article by M. DUCOS already mentioned above. For example, one can use a material of the "Sulzer-Metco" type.

In FIG. 3 one can see that the cavity defined by the wall in niobium presents a succession of cells in a string with rotational symmetry.

Each of the cells presents an equator region 46 of larger diameter and iris regions 44 of lower diameter.

The iris regions 44 link the cells together.

Figure 4:
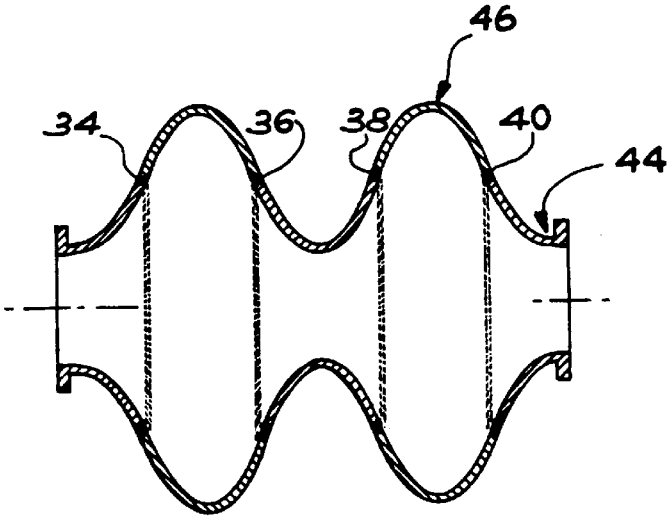
FIG. 4 represents a cavity structure in niobium with welds offset from the equator.

In the case where the dimensions of the cavities are such that one cannot use a process of tube shaping without welding, because of the risk of tearing the metal, one can preferably start from thin pressed sheet elements joined by welds made by laser beam or electron beam according to known techniques. Advantageously, as shown in FIG. 4, the welds 34, 36, 38, 40 are not made at the equator regions but are offset on either side of the equator. According to the invention, the structure in FIG. 4 is next intended to be coated with an external coating by plasma spraying, as described above.

The material sprayed can be copper, or tungsten, or a mixture of powders or materials making it possible to produce a porous thermal layer. For example, one can also produce a progressive Cu—Al layer, in the case of a deposit produced on niobium: the copper is then deposited in contact with the niobium, with which it presents a good acoustic impedance then, gradually, as one moves away from the niobium, one comes closer to a composition of pure aluminium, the aluminium presenting an acoustic impedance close to that of helium. The assembly thus presents an acoustic impedance evolving regularly, from that of niobium to that of the liquid helium in which the cavity is immersed.

As a variant, one can also make a first deposit of copper, then spray a layer of aluminium making the acoustic adaptation between the layer of copper and the helium.

Figure 5:
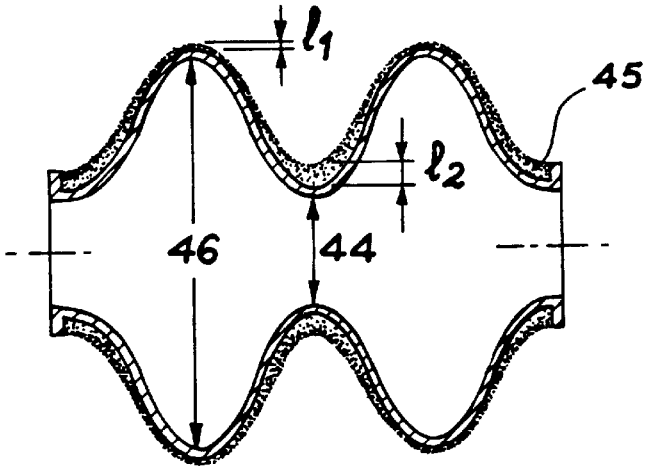
FIG. 5 represents a cavity structure according to the invention, with coating of variable thickness.

According to the invention, thicker layers are deposited locally. As illustrated in FIG. 5 one can, for example deposit, near the iris 44 of a corrugated structure, a thermally conducting layer 45 which is thicker than that at the equator 46 of this same structure. If $L_2$ represents the thickness of the layer at the iris and $L_1$ the thickness of the layer at the equator, one obtains: $L_2>L_1$, for example $L_2=2L_1$.

As shown in the figure, the thickness of the layer(s) can vary continuously between the values $L_1$ and $L_2$.

The numerical values of $L_1$ and $L_2$ are adapted to the dimensions of the cavity. For example, one can suggest values such as 1 mm$<L_1<L_2<$5 mm.

The structure according to the invention makes it possible to obtain rigidification, that is to say mechanical reinforcement, of a superconducting structure. In particular, in the case of a cavity for a particle accelerator, good mechanical stability is obtained vis-à-vis the Lorentz forces. The accelerator then comprises a tube with corrugations, with the shape shown in FIG. 1A or 1B, this tube in superconducting material being reinforced by a layer of material deposited by plasma, as described above. Besides this, the accelerator comprises means for introducing a radio-frequency wave (a klystron), a container for liquid helium, and the appropriate means for generating an accelerating electric field.

The invention also makes it possible to improve the thermal properties of the superconducting material. The physical properties which determine the thermal performance of the superconducting element and, thus, in the case of accelerator cavities, the constituent thickness of the structure of the cavities, in terms of available enthalpy and access to the cold source, are:

the thermal conductivity $\lambda$ in W/mK, the volume density specific heat $\rho C_V$ where $\rho$ and $C_V$ respectively represent the density and the specific heat at constant volume, the interface resistance between materials, also called the Kapitza resistance $R_K$. This resistance represents the effect of a temperature jump, at the level of the interfaces, in the presence of a heat flux. One can also talk of interface conductivity $h_k(R_k=1/h_k)$.

As far as the latter parameter $h_K$ is concerned, it can be said that the interface thermal resistance between two materials depends on the thermal coupling linked with the acoustic phonons in the media located on either side of the interface. The thermal coupling is poorer when there is a lack of acoustic adaptation between the two media.

As far as the heat flux linked to the phonons is concerned, it can be shown that, at an interface, it depends on the exchange surface between the two interfaces. The more the exchange surface increases, the more the heat flux rises. The coating structure according to the invention, which makes it possible to produce a porous coating, thus having a large exchange surface, therefore makes it possible to improve significantly the thermal exchanges between the element in superconducting material, for example the tube, or the sheet, of niobium, and its external coating. In the case of an accelerator cavity, an efficient heat flow makes it possible to ensure stable thermal operation of the cavity, without noticeable degradation of the HF characteristics, the accelerator electric field $E_{acc}$ and the quality factor Q.

In the same way, on the outer side of the coating, one needs to have a solid material with low acoustic impedance, so as to lower the interface resistance at the helium bath. This is the reason why a deposit of aluminium, or a material of the epoxy type, can advantageously be placed on top of a copper or tungsten coating.

A material which improves the Kapitza resistance which moreover, preferably, has good thermal conductivity. This is the case for aluminium, but is not the case for epoxy resins.

I claim:

1. A particle accelerator cavity with multiple cells, in which the cells present a region of higher diameter, called the equator region (46) and end regions of lower diameter called iris regions (44) which link the cells together, the cells being delimited by a wall in a material with superconducting properties which is coated with at least one layer of a thermal conducting material, characterised in that the layer of thermal conducting material presents a thickness which is higher in the iris regions than in the equator regions of the cells.

2. A cavity according to claim 1, in which the layer of thermal conducting material has a thickness which varies continuously between a first value $L_1$ at the equator regions and a second value $L_2$ at the iris regions, the first value $L_1$ being lower than the second value $L_2$.

3. A cavity according to claim 2, in which: 1 mm$<L_1<L_2<$5 mm.

4. A cavity according to claim 1, in which the thermal conducting material has a porous structure.

5. A cavity according to claim 1, in which the thermal conducting material is chosen from amongst copper, tungsten or a progressive copper-aluminium alloy.

6. A cavity according to claim 1, in which the wall is formed of a plurality of elements assembled by welding.

7. A cavity according to claim 1, in which the layer of thermal conducting material is coated with a layer of a material having a lower acoustic impedance than that of the thermal conducting material.

8. A cavity according to claim 1, in which the material with superconducting properties is niobium (Nb).

9. A production process for an accelerator cavity comprising a plurality of cells with equator regions of higher diameter and iris regions of lower diameter, and delimited by a wall in a material with superconducting properties, in which a layer of thermal conducting material is formed at the surface of the said wall by plasma spraying, characterised in that the thermal conducting material is sprayed in such a way as to form a layer which is thicker in the iris regions than in the equator regions.

10. A process according to claim 9, in which a porous thermal conducting material is formed.

* * * * *

UNITED STATES PATENT AND TRADEMARK OFFICE

CERTIFICATE OF CORRECTION

PATENT NO. : 6,348,757 B1
DATED : February 19, 2002
INVENTOR(S) : Marini

It is certified that error appears in the above-identified patent and that said Letters Patent is hereby corrected as shown below:

Title page,
Item [22], the PCT information should read:
-- [22] PCT Filed Sep. 28, 1998 --

Signed and Sealed this

Twenty-second Day of October, 2002

*Attest:*

*Attesting Officer*

JAMES E. ROGAN
*Director of the United States Patent and Trademark Office*